US008745762B2

(12) United States Patent
Lamanna et al.

(10) Patent No.: US 8,745,762 B2
(45) **Date of Patent: *Jun. 10, 2014**

(54) VISOR ASSEMBLY FOR A HELMET

(71) Applicant: Gentex Corporation, Carbondale, PA (US)

(72) Inventors: Robert Lamanna, Moscow, PA (US); George D. Hedges, Greenfield Township, PA (US); Timothy G. Allard, Dalton, PA (US)

(73) Assignee: Gentex Corporation, Carbondale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/739,861

(22) Filed: Jan. 11, 2013

(65) Prior Publication Data

US 2014/0075653 A1 Mar. 20, 2014

Related U.S. Application Data

(63) Continuation of application No. 11/416,049, filed on May 2, 2006, now Pat. No. 8,375,462.

(51) Int. Cl.
*F41H 1/04* (2006.01)

(52) U.S. Cl.
USPC ..... 2/6.3

(58) Field of Classification Search
USPC ..... 2/5, 6.3, 9, 10, 439, 426, 13, 100, 452, 2/175.5, 6.1, 410
See application file for complete search history.

(56) References Cited

U.S. PATENT DOCUMENTS

| | | | |
|---|---|---|---|
| 3,066,305 | A | 12/1962 | Aileo |
| 3,721,994 | A | 3/1973 | De Simone et al. |
| 4,847,920 | A | 7/1989 | Aileo et al. |
| 4,918,753 | A | 4/1990 | Mermillod |
| 5,187,502 | A | 2/1993 | Howell |
| 5,937,439 | A | 8/1999 | Barthold et al. |
| 6,845,548 | B1 | 1/2005 | Lin |

FOREIGN PATENT DOCUMENTS

| | | |
|---|---|---|
| GB | 820745 | 9/1959 |

OTHER PUBLICATIONS

European Search Report dated Feb. 23, 2009 for Application No. 07251790.7-1256.

*Primary Examiner* — Tejash Patel
(74) *Attorney, Agent, or Firm* — Morgan Lewis & Bockius LLP

(57) ABSTRACT

A visor assembly for an aviation helmet includes a lens, lens/strap anti-tear interface assemblies, retainer plates, and attachment strap assemblies. A friction strip mounted on the brim of the helmet operates to increase the friction between the visor lens and the helmet. The combined function of the friction strip and the configuration of the strap assemblies operate to maintain the visor in a deployed (as-worn) positioned in front of the wearer's face, even during high speed wind blasts of up to 600 KEAS (Knots Equivalent Air Speed).

24 Claims, 5 Drawing Sheets

VISOR ASSEMBLY FOR A HELMET

CROSS-REFERENCE TO RELATED APPLICATIONS

This application is a Continuation of U.S. patent application Ser. No. 11/416,049 filed on May 2, 2006 which is incorporated herein by reference in its entirety.

BACKGROUND OF THE INVENTION

1. Field of the Invention

The present invention relates generally to helmets. More particularly, it relates to a visor assembly for a helmet that is capable of withstanding ejection or windblast forces up to 600 knots equivalent air speed (KEAS).

2. Description of Related Art

Various bungee or elastic mountings of visors for helmets are known in the prior art. However, the bungee/elastic strap or webbing mounting arrangement suffers from many deficiencies. For example, the known bungee/elastic strap or webbing mounting methods are not rigid throughout the entire arrangement, and are therefore susceptible to strong wind gusts that can literally blow the visor off of the helmet.

U.S. Pat. No. 4,847,920 discloses a dual-visor assembly for a helmet. An inner visor is releasably secured to the helmet by snap fasteners that release toward the rear of the helmet, while an outer visor is releasably secured to the helmet over the inner visor by snap fasteners that release toward the front of the helmet to prevent the inadvertent release of both visors simultaneously. This dual visor assembly, however, is not capable of withstanding high speed windblasts.

Accordingly, it would be desirable and highly advantageous to have a visor assembly for helmets that overcomes the above-described problems of the prior art.

SUMMARY OF THE INVENTION

The visor assembly according to the present principles advantageously keeps the visor lens in place, in front of the wearer's face, through ejection and/or windblast forces of up to 600 Knots Equivalent Air Speed (KEAS). A reinforced strap mechanism secures the visor to the helmet in a more secure manner than that of the existing known mechanisms. A friction strip mounted on the brim of the helmet and extending the width of the facial frontal opening of the helmet, functions to "grab" the visor lens and prevent the possibility of its upward rotation during ejection and/or windblast forces.

In addition, the reinforced strap mechanism, coupled with an anti-tearing attachment interface to the visor lens, is used to prevent tearing of the strap from the visor lens.

A portion of the visor lens rests on the friction strip when in the as-worn position in front of the wearer's face. In other embodiments, the friction strip may include, but is not limited to, rubber and/or other materials that provide an increased friction or tacky surface with respect to the visor lens.

The combination of the lower mounted visor attachment mechanism and the friction strip functions to resist windblast jarring forces of up to 600 KEAS and retain the visor lens in its deployed (as-worn) position in front of the face. This protects the wearer and decreases the chance of windblast air getting inside the helmet. This directly decreases the possibility of the potential risk of injury to the face and neck of the wearer.

In accordance with one aspect of the present principles, the aviation helmet includes a bungee visor assembly, and a friction strip mounted on the helmet above a facial opening and adapted for increasing frictional contact between the visor and the helmet. The friction strip can be positioned and mounted on the brim of the helmet.

The bungee visor assembly generally includes a visor lens, and strap assemblies having a first portion connected to the visor and a second portion releasably connected to the helmet. Snap fasteners connected to the end of the second portion releasably connect the straps to the helmet.

The first portion of the straps comprise an elastic material and the second portion comprises a non-elastic material. In addition, the second portion includes a length adjustment device. The first portion of the straps is connected to the visor at two points, thereby forming a V-shape of said first portion of the straps.

An attachment means connects the non-elastic second portion of the straps to said first elastic portion at the point of the V-shape. The attachment means enables the elastic first portion of the straps to float and self adjust the position of said attachment means with respect to the first elastic portion.

According to one preferred aspect, the first elastic portion is connected to the outside surface of the visor lens, thereby allowing the visor lens to lay as close as possible to the surface of the helmet.

According to another aspect, lens/strap anti-tear interfaces cover the strap assemblies on an outer surface of said visor lens. The lens/strap anti-tear interfaces have a thickness with respect to a direction of air flow over the helmet during a high speed wind blast. This thickness of the lens/strap anti-tear interfaces create a barrier or air dam that acts to stagnate the local air flow around the helmet. The created air stagnation generating additional force against the visor lens that tends to push the same more tightly against the helmet and said friction strip.

These and other aspects, features and advantages of the present principles will become apparent from the following detailed description of preferred embodiments, which is to be read in connection with the accompanying drawings.

DETAILED DESCRIPTION OF PREFERRED EMBODIMENTS

The visor assembly according to the present principles may be used to assist in preventing injury to aircrew flying tactical jet aircraft with ejection seats capable of 600 KEAS. More-over, it is to be further appreciated that the visor assembly of the present principles is not limited to any one particular applications and may also be utilized by aircrew in other aircraft types.

Figure 1:
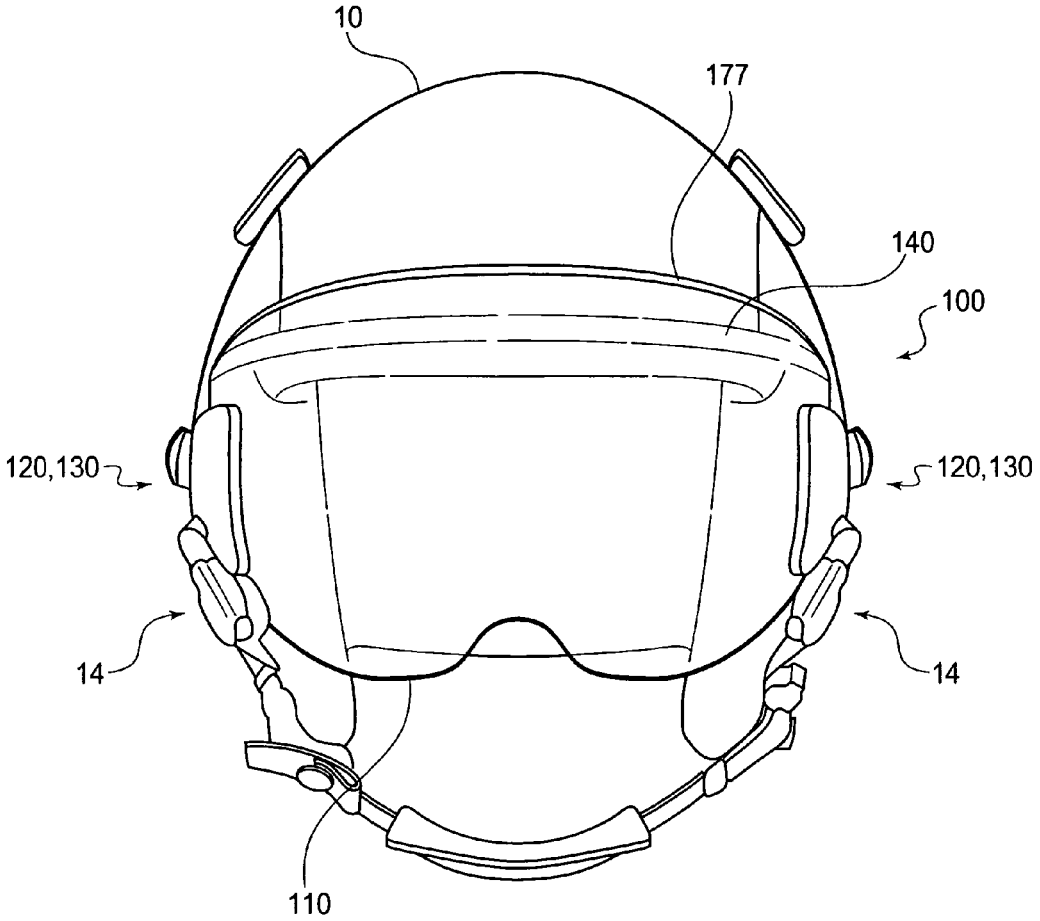
FIG. 1 is a diagram illustrating a visor assembly according to an embodiment of the present principles.

FIG. 1 shows a diagram of the visor assembly 100 for a helmet 10, according to an embodiment of the present principles. Helmet 10 includes two connectors 12 on opposing sides of the helmet (See FIG. 3). The connectors 12 each receive a mating connector 133C of the visor assembly. The helmet 10 may include at least one bayonet receiver 14 for securing an oxygen mask (not shown) to the helmet.

Figure 2A:
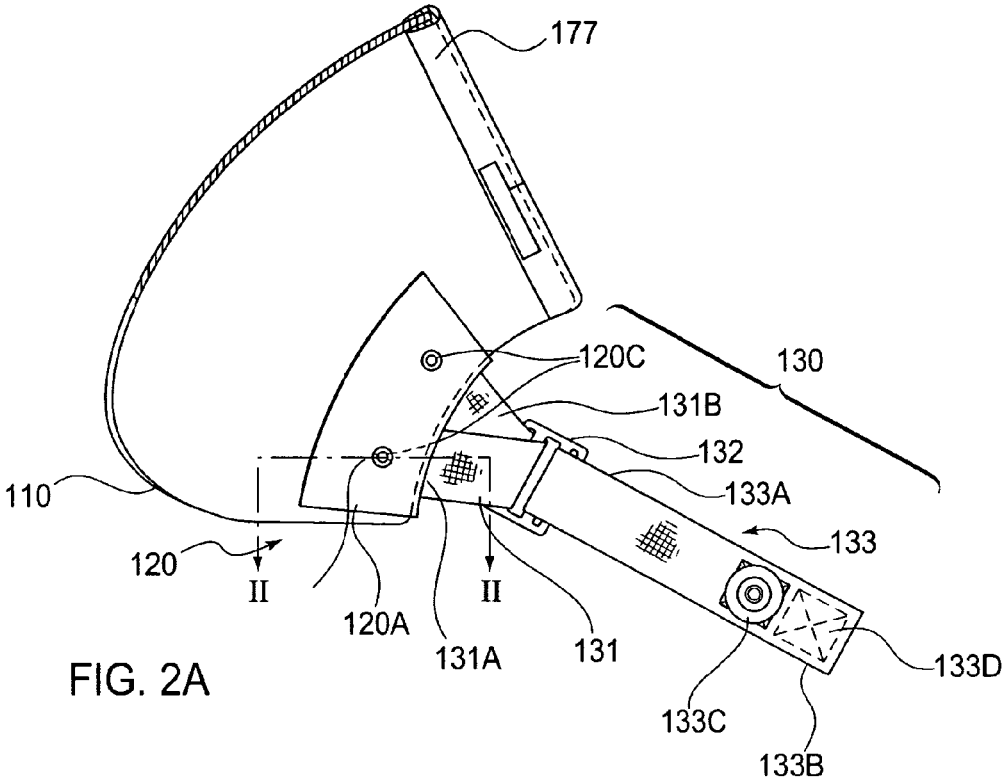
FIG. 2*a* is a partial cross section of the visor lens showing two retainer plates or stress relieving plates from the inside surface of the visor lens, according to an embodiment of the present principles.
Figure 2B:
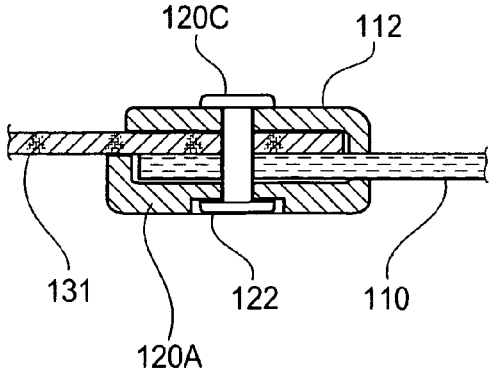
FIG. 2*b* is a partial cross sectional view of the mounting of the strap assembly to the visor taken along line II-II of FIG. 2*a*, according to an embodiment of the present principles.

Referring to FIGS. 2*a* and 2*b*, the visor assembly 100 includes a lens 110, two lens/strap anti-tear interface assemblies 120 and two attachment strap assemblies 130. The lens/strap anti-tear interface assemblies 120 include stress relieving plates 120A on the inside surface of the lens 110 and lens/strap anti-tear interfaces 112 (see FIG. 3) on the outside surface of the lens 110. To complete the kit, a friction strip 140 is attached to the brim of the helmet (See FIGS. 1 and 4).

The lens 110 of the visor assembly 100 may be formed from polycarbonate or any other suitable known material(s). The lens 110 preferably has an edge beading 177 disposed on an upper edge thereof.

Figure 3:
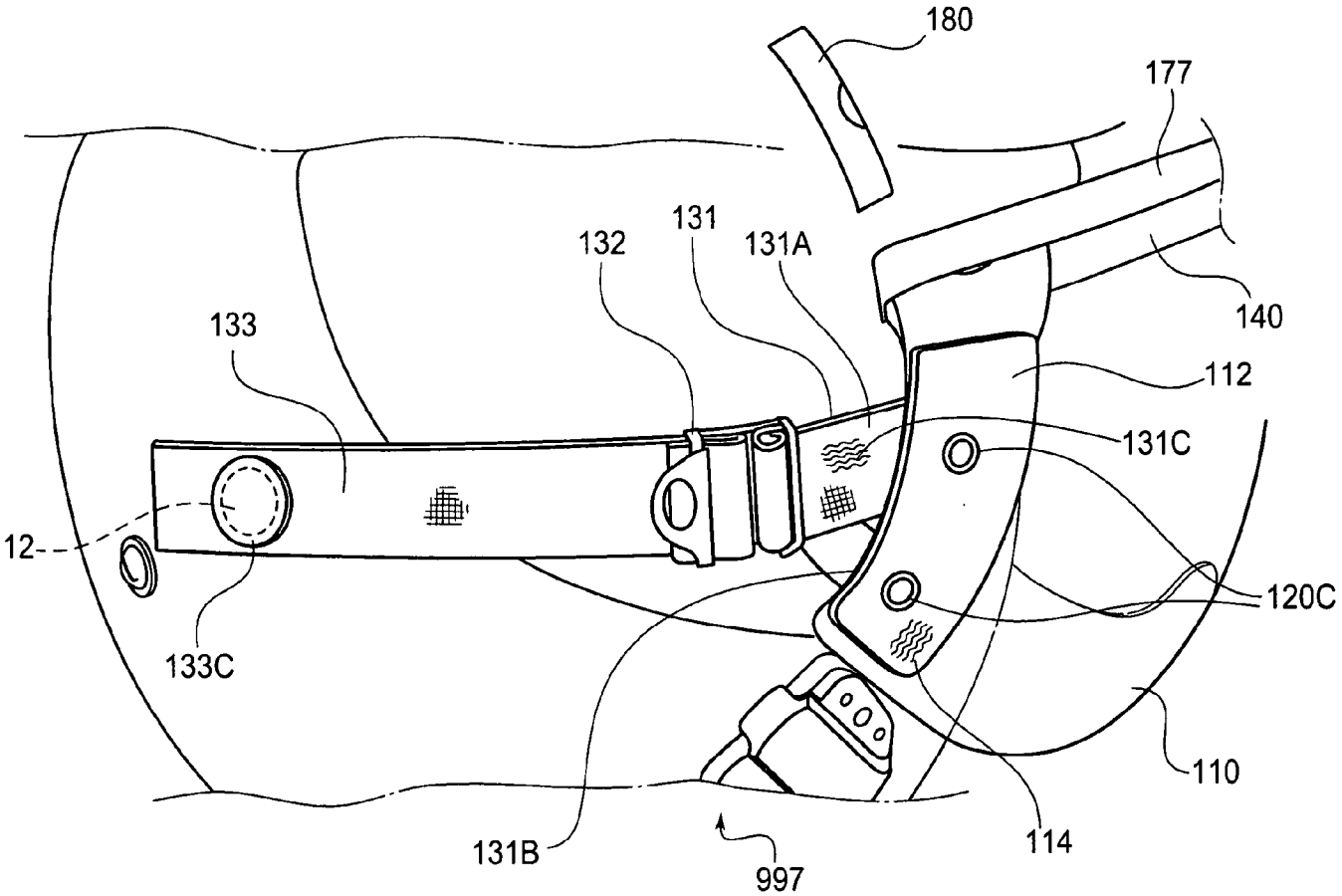
FIG. 3 is a diagram illustrating one of the two lens/strap anti-tear interfaces and a corresponding one of the two attachment strap assemblies from the outside surface of the visor lens, according to an embodiment of the present principles.

Referring to FIGS. 2*a*, 2*b* and 3, each of the attachment strap assemblies 130 includes an elastic/bungee strap 131, a strap-to-strap connector 132, and a nylon (i.e., non elastic) strap 133. The strap-to-strap connector 132 may be, but is not limited to, a ladder latch or other strap-to-strap connecting device. In addition, strap-to-strap connector 132 provides length adjustment capability to the strap assembly 130, and more specifically to the nylon strap portion 133 of the same.

The elastic/bungee strap 131 has a first end 131A and a second end 131B. In accordance with a preferred embodiment, the elastic strap 131 is a singular piece of elastic material that passes through connector 132 such that first end 131A and second end 131B are attached to the anti-tear interface assembly 120. In this configuration, the thickness of the strap 131 is effectively doubled between the connector 132 and the anti-tear interface assembly 120. In addition, the elastic/bungee strap forms a V-shape with the strap-to-strap connector 132 when connected in this manner. In this configuration, the strap-to-strap connector 132 allows the elastic/bungee strap 131 to "float" and self-adjust the location of the strap-to-strap connector along the side of the helmet. This "floating" or self adjusting aspect of the present principles optimizes the ability of the visor lens 110 to lay as closely as possible against the helmet, and more particularly, against friction strip 140. This allows the visor assembly of the present principles to withstand high speed wind blasts while remaining in the deployed (i.e., as-worn) position.

In accordance with another embodiment, elastic/bungee strap 131 may include one or more tear resistant fibers (hereinafter "tear resistant fibers") 131C integrated therein or sewn thereto. The tear resistant fibers 131C may be integrated into (e.g., during manufacturing of the textile) or sewn onto the elastic/bungee strap 131 throughout the same or at one or more selected locations. Preferably, the tear resistant fibers 131C are at least disposed in the ends 131A and 131B proximate to a junction of the elastic/bungee strap 131 and a corresponding one of the two lens/strap anti-tear interface assemblies 120 to further prevent tearing of the elastic/bungee strap 131 from the lens/strap anti-tear interface. Such anti-tearing properties may be achieved solely from the use of the tear resistant fibers 131C and/or the structures included in each of the lens/strap anti-tear interface assemblies 120 described in further detail below.

The tear resistant fibers 131C may be integrated into or sewn onto the strap 131 in various different directions with respect to the strap. For example, the tear resistant fibers 131C can be disposed into/onto strap 131: 1) in a direction substantially perpendicular to an adjustment direction of the elastic strap; 2) in a direction substantially parallel to an adjustment direction of the elastic strap; 3) in an interwoven mesh having both substantially parallel and perpendicular components with respect to the adjustment direction of the elastic strap; and 4) or any other arrangement including, but not limited to, diagonal arrangements and so forth.

It is to be appreciated that the tear resistant fibers 131C may include KEVLAR® and/or any other suitable material such that the tear-resistant fibers comprise a material having a greater tear resistance than the material that forms the elastic/bungee strap 131. It is to be further appreciated that the tear resistant fibers 131C may also be integrated into or sewn onto the nylon strap 133 for further reinforcement of the strap assembly 130.

The nylon strap 133 has a first end 133A and a second end 133B. The first end 133A of the nylon strap connects to the strap-to-strap connector 132. The second end 133B of the nylon strap 133 has a connector 133C attached thereto for mating to a corresponding one of two connectors 12 included on the helmet 10. The mating connectors 12 and 133C may include, but are not limited to, a female snap connector and a male snap connector.

Each of the lens/strap anti-tear interface assemblies 120 include a stress relieving plate 120A and rivets 120C for securing the ends 131A and 131B of the elastic/bungee strap 131 to the lens 110. That is, stress relieving plate 120A and rivets 120C are adapted to provide a clamping force to the ends 131A and 131B of the elastic strap 131 with respect to the lens 110. The plate 120A may be made of plastics and/or other materials. In one preferred embodiment, the plate 120A is formed from a plastic like acrylonitrile butadiene styrene (ABS), such as, for example, CYCOLAC®.

In accordance with the preferred embodiment, each of the lens/strap anti-tear interfaces assemblies 120 is fixedly disposed on respective lower portions of the lens 110, on the exterior surface of lens 110. By connecting the elastic/bungee strap 131 to the outer surface of the lens 110, this reduces the clearance required for the visor assembly 100 and results in the visor assembly being pulled closer to the surface of the helmet 10. The stress relieving plates 120A are located on the interior surface of the visor lens 110 and operate to prevent deterioration of the plastic material of the visor around the holes through which the rivet bodies pass. These stress relieving plates have been made as thin as possible to allow the visor lens 110 to lay as close to the helmet surface as possible. The stress relieving plates 120A preferably contain counterbores 122 in order to allow the rolled over rivet heads of rivets 120C to be recessed and not come into contact with the helmet surface when the visor is moved into its deployed or stowed positions.

The attachment points to the lens 110 for the elastic strap ends 131A and 131B are preferably over sewn in a "boxed, X-pattern" to prevent the elastic straps 131 from tearing away from the rivets 120C while under load. For example, this sewing pattern indicated by 133D (See FIG. 2*a*) on the end of nylon strap 133 would be included at the ends 131A and 131B (disposed under plate 112 in FIGS. 2*b* and 3). The ends 133A and 133B of the nylon straps 133 may be seared to prevent fraying, and the ends of the elastic straps 131 may be dipped, sprayed, and/or otherwise exposed to a "fray-free" edge sealant prior to or after cutting to prevent fraying.

Shown in FIG. 2*b*, the thinness of the stress relieving plates 120A functions to allow the visor assembly 100 to be integrated into helmets having night vision goggle (NVG) brackets 180 so that the visor can function without interference from the brackets (See FIG. 3). According to one embodiment, the stress relieving plates are no more than 0.10 inch thick.

In FIG. 3, each of the lens/strap anti-tear interface assemblies 120 are disposed on the lens 110 in a position that optimizes the pull-in force on the lens 110 against the helmet 10, when each of the attachment strap assemblies 130 is coupled to the helmet 10. The optimized pull-in force works to keep the lower edge of the visor pulled in tight at the visor oxygen mask interface, thus preventing any air blast from entering the helmet.

Figure 4:
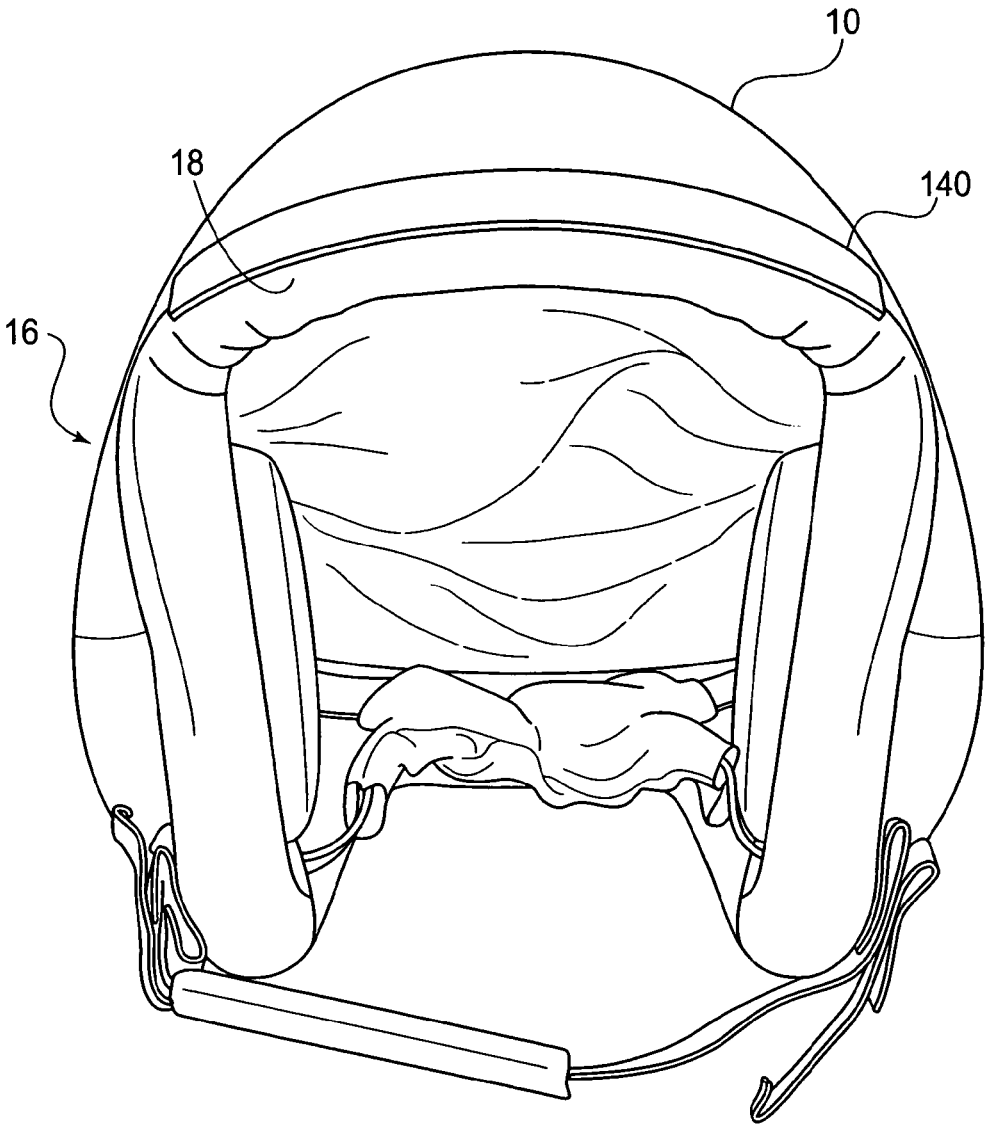
FIG. 4 is a diagram illustrating the friction strip disposed on the helmet as part of the visor assembly according to an embodiment of the present principles.

Referring to FIGS. 1 and 4, there is shown what is referred to herein as a friction strip 140, according to an illustrative embodiment of the present principles. The friction strip 140 can be adhesively connected to the brim of the helmet and is adapted to provide a gripping and/or frictional force to a portion of the lens 110 when each of the two attachment strap assemblies 130 is coupled to the helmet 10, so as to maintain the lens 110 in a fixed, as-worn position in front of the face of the wearer. The brim of the helmet is defined herein as the line above and across the facial opening 16. The facial opening generally includes an edge roll portion 18 disposed around the facial opening 16. When the visor is disposed in front of the user's face (as shown in FIGS. 1 and 3), the lens beading 177 is still above the friction strip 140, thus allowing the friction strip 140 to make intimate (i.e. direct) contact with the visor lens inner surface. Friction strip 140 functions to increase the frictional contact between the helmet 10 and the visor lens 110.

In a preferred embodiment of the present principles, at least the combination of the pull-in force of the strap assembly 130 and the gripping force (or frictional force) generated by the friction strip 140, retains the lens 110 in a fixed position in the as-worn position in front of the face of the wearer in the presence of ejection and/or windblast forces of up to 600 KEAS.

Figure 5:
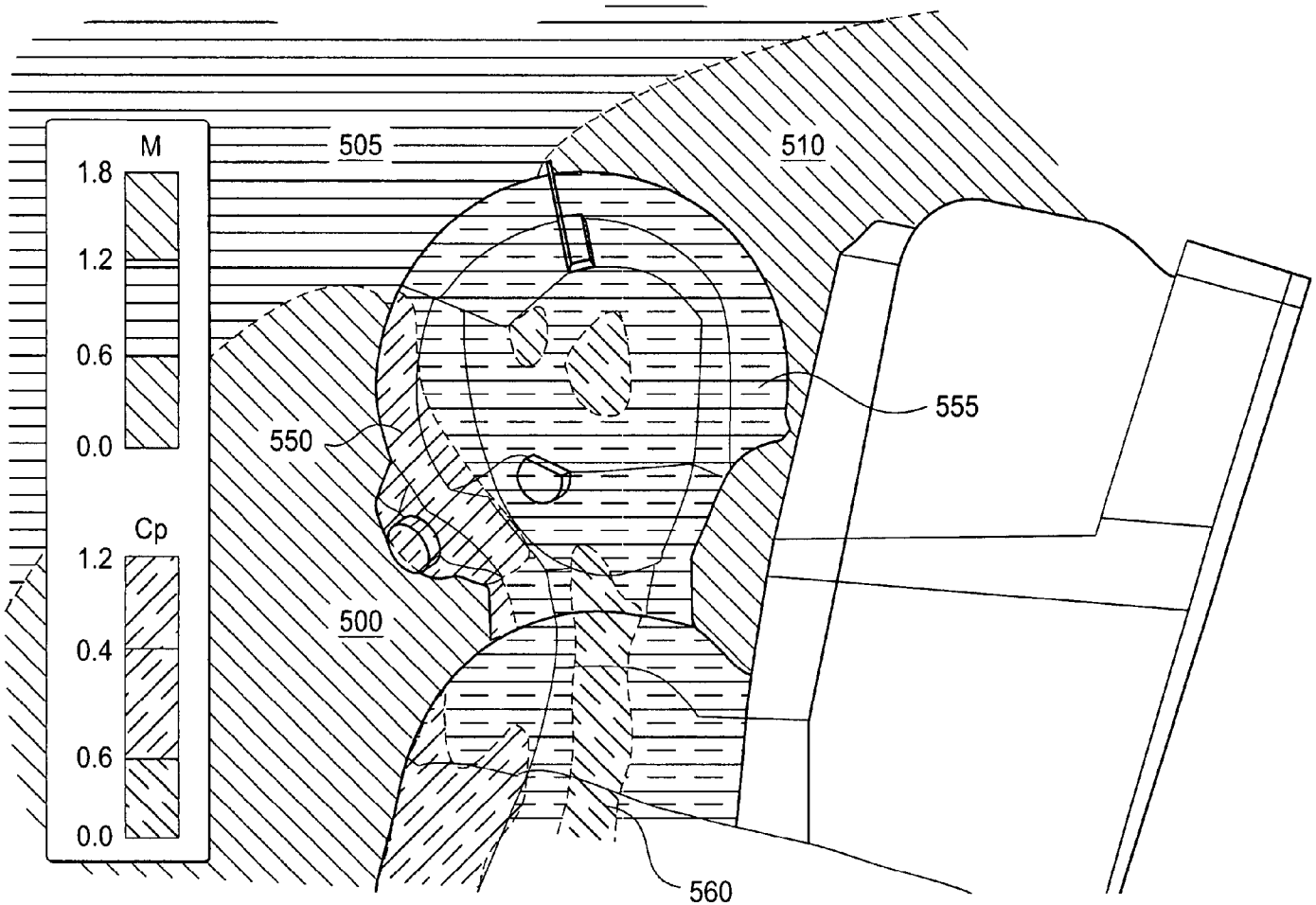
FIG. 5 is a diagram illustrating the surface pressure coefficient and Symmetry plane mach contours of aircrew and their helmet/visor assembly during a 600 KEAS windblast with the visor assembly according to the present principles.

Referring to FIG. 3, on exterior surface of the lens 110, the lens/strap anti-tear interface assemblies 120 include lens/strap anti-tear interfaces 112 that are adapted to cover the connection strap assemblies 130 at the outer surface. These lens/strap anti-tear interfaces have a thickness with respect to the direction of airflow during a high speed air blast. This thickness of the lens/strap anti-tear interfaces 112 creates a barrier or air dam that acts to stagnate the local air flow (i.e., immediately in front of the helmet), thus creating an additional force against the visor that tends to push it more tightly up against the helmet, and more specifically the friction strip 140. FIG. 5 shows this concept more clearly.

In addition, the exterior surface of the lens/strap anti-tear interface 112 may include a hook and loop type fastener 114, such as, for example VELCRO® or any other suitable known fastener. The fastener 114 can be used for securing a lens protector (not shown) thereto. The fastener strip 114 may be disposed on the lens 110 using at least one of the rivets 120C, adhesives, or any other means and/or devices that would secure the fastener strip to the lens 110. It is to be appreciated that the same at least one rivet 120C may be further used to fixedly couple at least one of the two lens/strap anti-tear interfaces 112 to the lens 110.

Referring to FIG. 5, there is shown a diagram of the surface pressure coefficient (Cp) and symmetry plane mach (M) contours when the visor assembly of the present principles is subject to 600 KEAS with an angle of attack (AOA) of 17 degrees. As is shown by this diagram, there is a stagnation of air in region 500 at the base of the deflector (visor) that creates increased pressure on/against the deflector/visor assembly. This increased surface pressure is shown in the area identified as region 550. It is in this region that the coefficient of surface pressure (Cp) is the highest at 0.4-1.2.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. An aviation helmet comprising:

a helmet having a facial opening;

a brim having a length extending above the facial opening;

a visor elastically coupled to the helmet and extending across at least a portion of the facial opening in a deployed position; and at least one friction strip mounted along at least a portion of the length of the brim and positioned between the helmet and the visor in the deployed position, the at least one friction strip increasing frictional contact between the visor and the helmet in the deployed position.

2. The aviation helmet according to claim 1, wherein the visor comprises a visor lens and the at least one friction strip directly contacts an inner surface of the visor lens in the deployed position.

3. The aviation helmet according to claim 1, wherein the visor comprises:

a visor lens; and two or more strap assemblies each having a first portion connected to the visor and a second portion releasably connected to the helmet.

4. The aviation helmet according to claim 3 further comprising:

at least one snap fastener connected to an end of each second portion releasably connecting each of the two or more strap assemblies to the helmet.

5. The aviation helmet according to claim 3, wherein the first portion of each of the two or more strap assemblies comprises an elastic material and the second portion comprises a non-elastic material.

6. The aviation helmet according to claim 3, wherein the second portion of each of the two or more strap assemblies further comprises a length adjustment connector.

7. The aviation helmet according to claim 5, wherein the first portion of each of the two or more strap assemblies is connected to the visor at two points, thereby forming a V-shape of the first portion of each of the two or more strap assemblies.

8. The aviation helmet according to claim 7 further comprising:

a connector coupling the second portion of each of the two or more strap assemblies to the first portion at a point of the V-shape.

9. The aviation helmet according to claim 8, wherein the connector enables the first portion of each of the two or more strap assemblies to float and self adjust the position of the connector with respect to the first portion.

10. The aviation helmet according to claim 5, wherein the first portion is connected to an outside surface of the visor, thereby allowing the visor to lay as close as possible to a surface of the helmet.

11. The aviation helmet according to claim 1, wherein the visor further comprises a visor lens and a thin plate allowing the visor lens to lay close to the helmet, whereby the visor is adapted to integrate with a helmet-mounted bracket.

12. The aviation helmet according to claim 1 further comprising:

an oxygen mask releasably connected to the helmet.

13. The aviation helmet according to claim 3 further comprising lens/strap anti-tear interfaces for covering the two or more strap assemblies on an outer surface of the visor lens.

14. The aviation helmet according to claim 13, wherein the lens/strap anti-tear interfaces have a thickness with respect to a direction of air flow over the helmet during a high speed wind blast.

15. The aviation helmet according to claim 14, wherein the thickness of the lens/strap anti-tear interfaces create a barrier or air dam that acts to stagnate the local air flow around the helmet, the created air stagnation generating additional force against the visor lens that tends to push the same more tightly against the helmet and the at least one friction strip.

16. An aviation helmet having a facial opening, the helmet comprising:

a visor lens having opposing sides and extending across at least a portion of the facial opening of the helmet; and at least one strap assembly connected to each opposing side of the visor lens, the at least one strap assembly comprising:

a first elastic portion having at least one end connected to the visor lens;

a strap-to-strap connector receiving and securing the first elastic portion; and a second non-elastic portion having one end connected to the strap-to-strap connector and another end releasably connectable to the helmet.

17. The aviation helmet according to claim 16, wherein the strap-to-strap connector provides the second non-elastic portion with length adjustment capability.

18. The aviation helmet according to claim 16, wherein the first elastic portion of the at least one strap assembly operates to automatically adjust a position of the strap-to-strap connector with respect to the same.

19. The aviation helmet according to claim 17, wherein the first elastic portion passes through the strap-to-strap connector and further comprises two ends connected to the visor lens so as to form a V-shape of the first elastic portion with respect to the strap-to-strap connector and the visor lens.

20. The aviation helmet according to claim 16 further comprising lens/strap anti-tear interfaces for covering the strap assembly on an outer surface of the visor lens.

21. The aviation helmet according to claim 16 further comprising:

at least one friction strip mounted on a brim of the helmet above the facial opening, the at least one friction strip increasing frictional contact between the visor lens and the helmet when the visor lens is in a deployed position.

22. An aviation helmet comprising:

an aviation helmet having a facial opening;

a visor elastically coupled to the aviation helmet and positionable between a deployed and stowed position, the visor extending across at least a portion of the facial opening in the deployed position; and at least one friction strip mounted on the aviation helmet between the aviation helmet and the visor in the deployed position, the at least one friction strip engaging and retaining the visor in the deployed position in the presence of ejection and/or windblast forces of up to approximately 600 knots equivalent airspeed.

23. The aviation helmet according to claim 1, wherein the at least one friction strip is comprised of rubber.

24. The aviation helmet according to claim 1, wherein the at least one friction strip includes a tacky surface.

* * * * *